United States Patent [19]

Albrecht

[11] Patent Number: 4,940,114

[45] Date of Patent: Jul. 10, 1990

[54] ENGINE PRELUBRICATING SYSTEM

[76] Inventor: Kenneth D. Albrecht, Box 2, Leader Sask., Canada, S0N 1H0

[21] Appl. No.: 403,198

[22] Filed: Sep. 5, 1989

[51] Int. Cl.[5] ..... F01M 1/26

[52] U.S. Cl. ..... 184/6.3; 184/6.4; 184/104.2; 123/196 R; 123/196 S; 123/196 AB

[58] Field of Search ..... 184/6.3, 6.4, 104.1, 184/104.2, 108, 1.5; 123/196 R, 196 S, 196 AB

[56] References Cited

U.S. PATENT DOCUMENTS

| | | | |
|---|---|---|---|
| 2,102,514 | 12/1937 | Clarkson | 123/196 S |
| 2,343,168 | 2/1944 | Bickle | 184/6.4 |
| 2,747,564 | 5/1956 | Wehling | 123/196 S |
| 2,838,039 | 6/1958 | Smith et al. | 184/6.3 |
| 2,889,821 | 6/1959 | Maki | 184/6.3 |
| 3,033,311 | 5/1962 | Edgar | 184/1.5 |
| 3,066,664 | 12/1962 | NcNew et al. | 123/196 S |
| 3,272,535 | 9/1966 | Neely | 184/1.5 |
| 3,722,623 | 3/1973 | Waldecker | 184/6.3 |
| 4,168,693 | 9/1979 | Harrison | 123/196 S |
| 4,199,950 | 4/1980 | Hakanson et al. | 123/196 CP |
| 4,299,307 | 11/1981 | Scott | 184/6.4 |
| 4,359,140 | 11/1982 | Shreve | 184/6.3 |
| 4,502,431 | 3/1985 | Lulich | 123/179 A |
| 4,628,877 | 12/1986 | Sundles et al. | 123/196 S |
| 4,703,727 | 11/1987 | Cannon | 123/196 S |

FOREIGN PATENT DOCUMENTS

| | | | |
|---|---|---|---|
| 0115418 | 7/1984 | Japan | 184/108 |

*Primary Examiner*—Ira S. Lazarus
*Assistant Examiner*—Alan B. Cariaso
*Attorney, Agent, or Firm*—Jerry T. Kearns

[57] ABSTRACT

A prelubricating system for an internal combustion engine includes an oil intake dimensioned for insertion into the dipstick well of the engine. The oil intake tube is connected to an inlet side of an electric pump. An outlet side of the pump is connected to the oil pressure sender coupling aperture on the engine block for supplying oil to internal oil passages. A pressure activated switch causes actuation of the electric oil pump when the engine ignition switches is activated. When a predetermined oil pressure is achieved, the electric pump is deactuated and the engine starter motor solenoid is energized. In a second embodiment, the system includes an electric oil heater and a thermostatic control for preventing starting of the engine until a predetermined oil pressure and temperature has been reached. The oil intake tube includes a quick release coupling and a graduated scale for measuring the quantity of oil in the sump. Check valves are provided for preventing reverse oil flow from the engine block and from the intake side of the pump back to the sump through the oil intake tube.

7 Claims, 4 Drawing Sheets

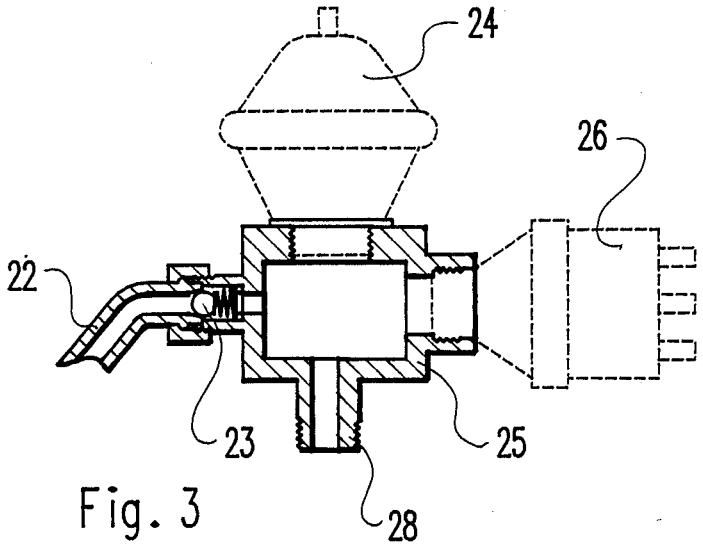
Fig. 3
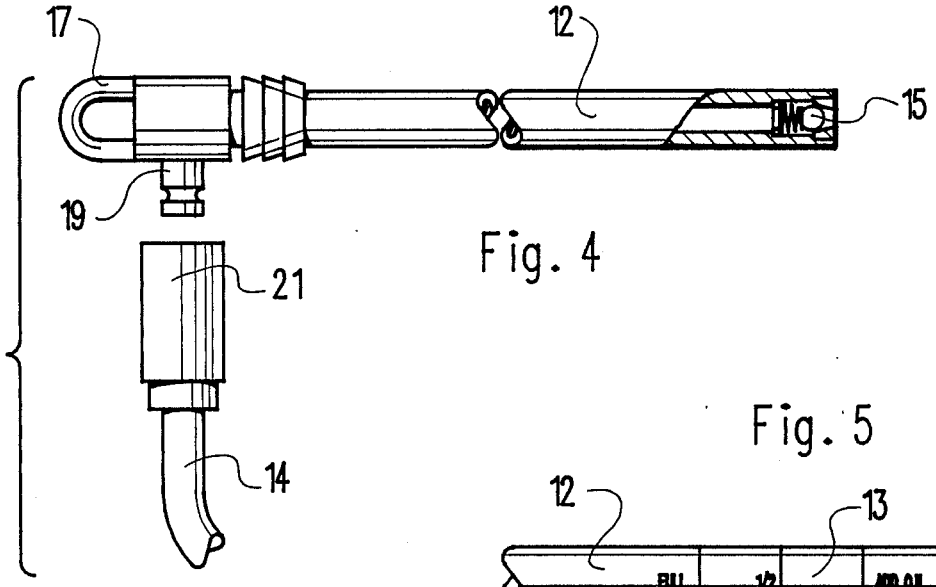
Fig. 4
Fig. 5
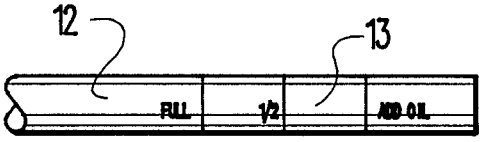

ENGINE PRELUBRICATING SYSTEM

BACKGROUND OF THE INVENTION

1. Field of the Invention

The present invention relates to engine prelubricating systems, and more particularly pertains to an engine prelubricating system for lubricating internal combustion engine bearings prior to starting the engine. A variety of prelubricating systems have been proposed in the prior art. A major problem with these conventional systems is the difficulty of installing the system on the engine of a conventional vehicle. In order to overcome this problem, the present invention provides a prelubricating system including an intake tube adapted for insertion into the dipstick well of a conventional engine and including an outlet conduit adapted for connection to the engine block through the conventional oil pressure sender coupling. Internal combustions on many vehicles including cars, trucks, and heavy equipment are operated during winter months in extremely cold climates. Under these conditions, it can take several minutes after starting of the engine before an acceptable oil pressure level is achieved. Additionally, engines with turbo chargers have an especially critical need for rapid lubrication of the turbo charger impeller bearings.

2. Description of the Prior Art

Various types of engine prelubricating sYstems are known in the prior art. A typical example of such an engine prelubricating system is to be found in U.S. Pat. No. 3,722,623, which issued to D. Waldecker on Mar. 27, 1973. This patent discloses a diaphragm actuated pump for providing additional engine lubrication during start up cranking of an internal combustion engine. U.S. Pat. No. 4,199,950, which issued to A. Hakanson et al on Apr. 29, 1980, discloses a system for prelubricating an engine wherein lubricating oil is delivered to relatively movable parts of the engine during starting in the form of an atomized mist generated by an atomizing spray nozzle operating under high pressure conditions. U.S. Pat. No. 4,359,140, which issued to J. Shreve on Nov. 16, 1982, discloses an auxiliary engine oiler for use with an internal combustion engine. The device includes a reservoir for storing a lubricant under pressure during normal operation of the engine. Upon failure of the engine's lubrication system, or during a subsequent start up procedure, the device is operative to discharge the pressurized oil. U.S. Pat. No. 4,502,431, which issued to J. Lulich on Mar. 5, 1985, discloses an internal combustion engine lubrication system in which the engine is provided with an oil pumping system driven from the starter motor which generates normal operating oil pressure prior to combustion. The starter motor is energized with a first lower level of electrical energy during its precombustion oiling operation and a second, higher level of electrical energy during its engine cranking operation. U.S. Pat. No. 4,628,877, which issued to T. Sundles et al on Dec. 16, 1986, discloses a lubrication system for internal combustion engines having a mechanical type oil pump and a turbo charger. The system includes an auxiliary electrically operated oil pump, a first time delay relay connected to the ignition system to energize the electrically operated oil pump for a first time period after the ignition is turned on to prelubricate the engine, a second time delay relay to energize the electrically operated pump for a second period after the ignition is turned off to prelubricate the turbo charger. U.S. Pat. No. 4,703,727, which issued to J. Cannon on Nov. 3, 1987, discloses an engine prelubrication system which utilizes an external source of pressurized oil connected through the engine oil filter port for lubrication of internal engine parts.

While the above mentioned devices are directed to various engine prelubricating systems, none of these devices disclose the use of an oil intake tube dimensioned for insertion into the oil sump dipstick well of a conventional internal combustion engine. Additional features of the present invention, not contemplated by the aforesaid prior art devices, include a pressure actuated switch associated with an oil outlet conduit adapted for connection to a conventional oil pressure sending unit coupling on an engine block and the provision of an electric oil heating device in conjunction with a thermostatic control for preventing engine starting and cranking until a predetermined oil pressure and temperature have been reached. Inasmuch as the art is relatively crowded with respect to these various types of engine prelubricating systems, it can be appreciated that there is a continuing need for and interest in improvements to such engine prelubricating systems, and in this respect, the present invention addresses this need and interest.

SUMMARY OF THE INVENTION

In view of the foregoing disadvantages inherent in the known types of engine prelubricating systems now present in the prior art, the present invention provides an improved engine prelubricating system. As such, the general purpose of the present invention, which will be described subsequently in greater detail, is to provide a new and improved engine prelubricating system which has all the advantages of the prior art engine prelubricating systems and none of the disadvantages.

To attain this, representative embodiments of the concepts of the present invention are illustrated in the drawings and make use of a prelubricating system for an internal combustion engine which includes an oil intake tube dimensioned for insertion into the dipstick well of the engine. The oil intake tube is connected to an inlet side of an electric pump. An outlet side of the pump is connected to the oil pressure sender coupling aperture on the engine block for supplying oil to internal oil passages. A pressure activated switch causes actuation of the electric oil pump when the engine ignition switch is activated. When a predetermined oil pressure is achieved, the electric pump is deactuated and the engine starter motor solenoid is energized. In a second embodiment, the system includes an electric oil heater and a thermostatic control for preventing starting of the engine until a predetermined oil pressure and temperature has been reached. The oil intake tube includes a quick release coupling and a graduated scale for measuring the quantity of oil in the sump. Check valves are provided for preventing reverse oil flow from the engine block and from the intake side of the pump back to the sump through the oil intake tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine prelubricating system which has all the advantages of the prior art engine prelubricating systems and none of the disadvantages.

It is another object of the present invention to provide a new and improved engine prelubricating system which may be easily and efficiently manufactured and marketed.

It is a further object of the present invention to provide a new and improved engine prelubricating system which is of a durable and reliable construction.

An even further object of the present invention is to provide a new and improved engine prelubricating system which is susceptible of a low cost of manufacture with regard to both materials and labor, and which accordingly is then susceptible of low prices of sale to the consuming public, thereby making such engine prelubricating systems economically available to the buying public.

Still yet another object of the present invention is to provide a new and improved engine prelubricating system which provides in the apparatuses and methods of the prior art some of the advantages thereof, while simultaneously overcoming some of the disadvantages normally associated therewith.

Still another object of the present invention is to provide a new and improved engine prelubricating system for lubricating internal combustion engine bearings prior to cranking and starting of the engine.

Yet another object of the present invention is to provide a new and improved engine prelubricating system having an oil intake tube dimensioned for insertion into the dipstick well of a conventional engine oil sump and a pressure switch and oil outlet conduit adapted for connection in a conventional oil pressure sending unit coupling aperture on an engine block.

Even still another object of the present invention is to provide a new and improved engine prelubricating system including an electrically actuated oil pump and engine oil heater in conjunction with pressure sensitive and thermostatic control switches to prevent cranking and starting of an internal combustion engine until a predetermined oil pressure and temperature have been reached.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a detail view, partially in cross section, illustrating the construction of the oil outlet manifold.

FIG. 4 is a detail view, partially in cross section, illustrating the oil intake tube of the prelubricating system of the present invention.

FIG. 5 is a detail view, illustrating a volumetric measuring scale provided on the oil intake tube.

DESCRIPTION OF THE PREFERRED EMBODIMENT

Figure 1:
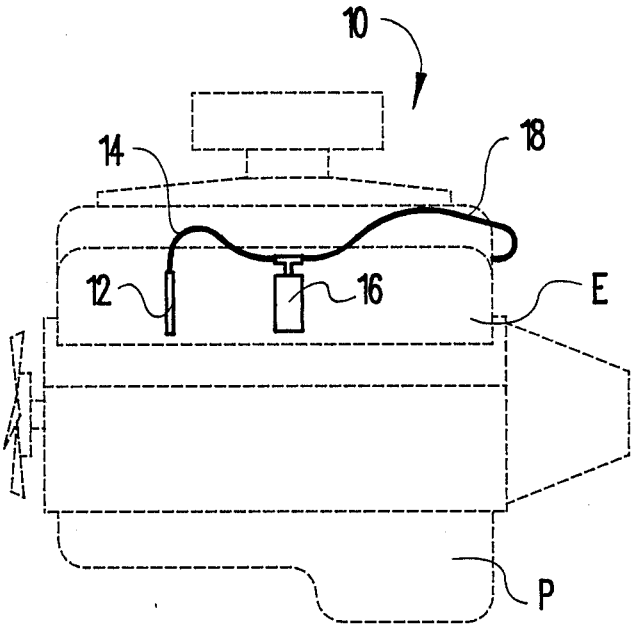
FIG. 1 is a side view diagrammatically illustrating the engine prelubricating system according to a first embodiment of the invention installed on a conventional engine block.

With reference now to the drawings, and in particular to FIG. 1 thereof, a new and improved engine prelubricating system embodying the principles and concepts of the present invention and generally designated by the reference numeral 10 will be described.

More specifically, it will be noted that the first embodiment 10 of the invention includes an oil intake tube 12 inserted within a dipstick well on a conventional internal combustion engine block E. The dipstick well communicates in a conventional manner with the oil sump located in the conventional oil pan P of the engine E. An oil intake conduit 14 is connected to an inlet side of an electric oil pump 16. An outlet conduit 18 is connected to an outlet side of the pump 16.

Figure 2:
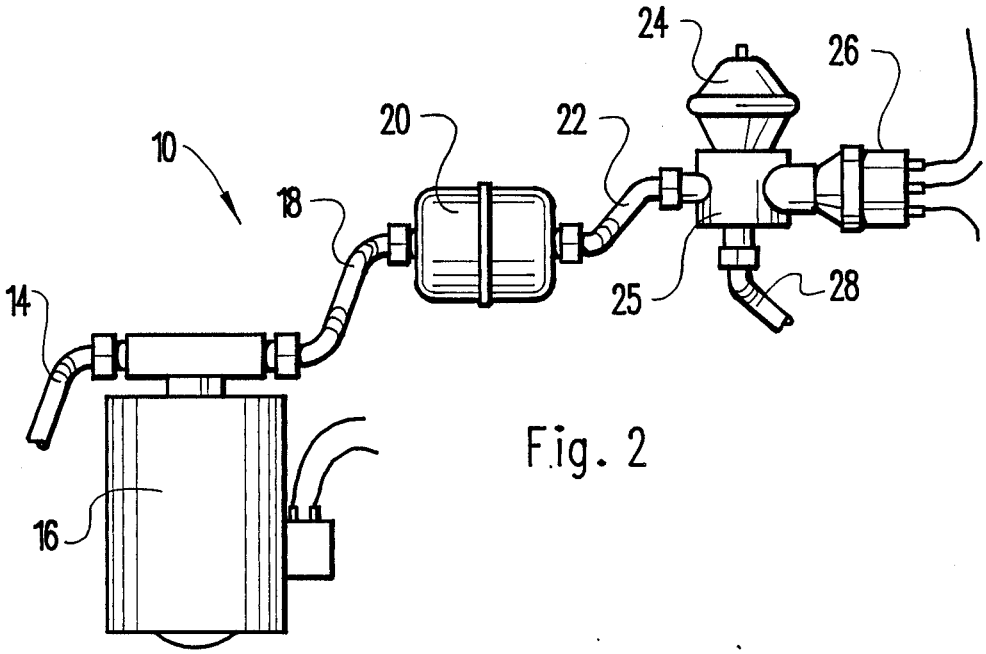
FIG. 2 is a detail view further illustrating the components of the prelubricating system of FIG. 1.

As shown in FIG. 2, the outlet conduit 18 is connected through an in-line filter 20 for filtering oil pumped therethrough. A downstream side of the filter 20 is connected through a conduit 22 to a manifold block 25. The manifold block 25 includes threaded apertures coupled to a conventional oil pressure sending unit 24 and a pressure actuated switch 26. The manifold 25 includes an outlet conduit 28 adapted for connection to a conventional oil sender threaded coupling aperture provided on an internal combustion engine block.

As shown in the detail view of FIG. 3, the outlet conduit 28 may take the form of a short externally threaded stem. The oil sending unit 24 is of a conventional construction and is connected in a well known manner to the vehicle oil pressure gage or indicating light. The pressure actuated switch 26 may be of a variety of conventional forms, without departing from the scope of the present invention. For example, a diaphragm or plunger type switch may be employed. The conduit 22 includes a ball check valve 23 for preventing reverse oil flow from the engine block through the outlet 28 and back through the conduit 22. This prevents engine oil from flowing through the prelubricating system after the engine has been started. Additionally, this allows accurate operation of the sending unit 24 during normal running of the engine.

FIG. 4 illustrates the oil intake tube 12. The tube 12 is a cylindrical tube provided with a ball check valve 15 at a lower end for preventing flow in a reverse direction through the bottom end of the tube 12 back into the engine oil sump. This feature maintains a quantity of oil in the intake tube 12 and the conduit 14 connected to the inlet side of the pump, and prevents the induction of air into the prelubricating system. Additionally, this prevents the oil pump from running dry. The oil intake tube 12 includes a loop type handle portion 17 at an upper end thereof for facilitating manual removal and installation of the tube 12 in a dipstick well. A quick release coupling is formed by cooperating connectors 19 and 21 for connecting the intake tube 12 to the conduit 14. The coupling members 19 and 21 may be of a snap frictional type, or a quick release threaded coupling. This feature allows disconnection of the intake tube 12 for removal from the dipstick well.

As shown in FIG. 5, the bottom end portion of the intake tube 12 may be provided with a graduated measuring scale 13 for measuring oil sump quantity in a conventional manner. Additionally, it should be noted that the length of the tube 12 may be selected such that the engine oil sump must be filled to the recommended level before the bottom end of the intake tube 12 will be immersed in oil. This would prevent individuals from starting an engine with a low oil level.

Figure 6:
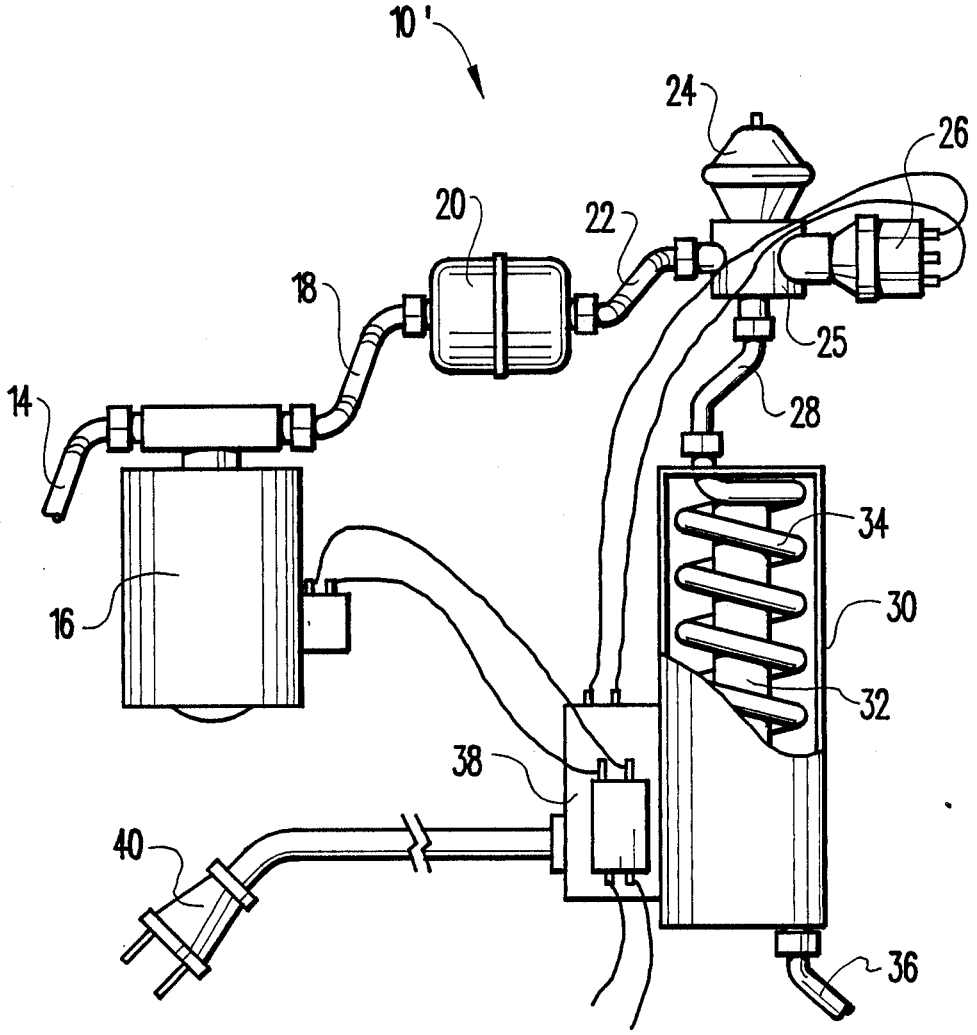
FIG. 6 illustrates a prelubricating system according to a second embodiment of the present invention in which an electric oil preheater is provided.

FIG. 6 illustrates a slightly modified second embodiment 10' of the invention, constructed in a similar fashion as described with respect to FIGS. 1 through 5. The second embodiment 10' includes an electric engine oil heater connected on the downstream outlet side of the pump 16. The engine oil heater may include a hollow cylindrical housing 30 having a centrally located elongated electric resistance heating element 32. A tubing coil 34 surrounds the heating element 32 and is connected by an outlet conduit 36 to the engine block oil sender coupling aperture. The electrical heating element 32 includes a thermostatic control unit 38 adapted for connection by a power cord 40 to a conventional AC power source.

Figure 7:
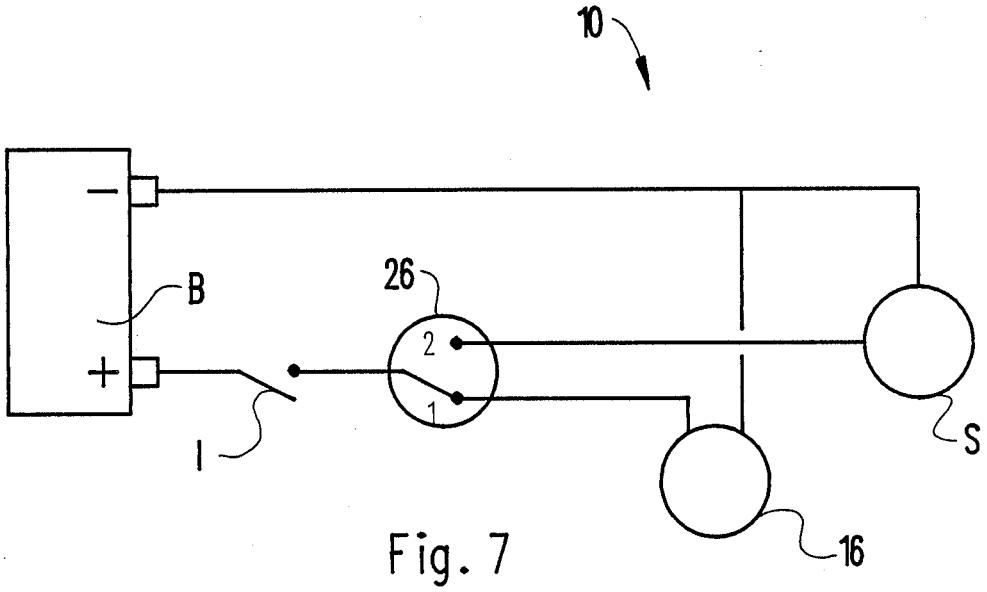
FIG. 7 is a schematic diagram illustrating the electrical components of the prelubricating system according to the first embodiment of the present invention.

FIG. 7 illustrating the electrical components of the first embodiment 10. The conventional 12 volt type automotive battery B is connected to a conventional vehicle key type ignition switch I. The pressure switch 26 has two positions as illustrated at one end 2. Upon closing of the ignition switch I, the pressure switch 26 will remain in position 1, thus energizing the electric oil pump 16. When the oil pressure reaches a predetermined level, the pressure switch 26 will move to position 2, thus deactuating the pump 16 and providing power to the starting motor solenoid S.

Figure 8:
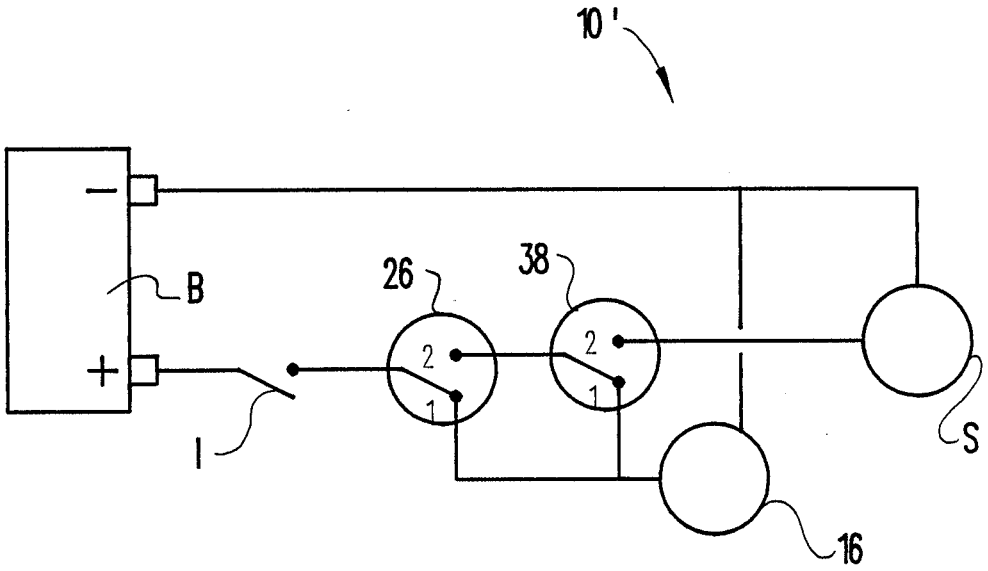
FIG. 8 is a schematic diagram illustrating the electrical components of the prelubricating system according to the second embodiment of the present invention.

FIG. 8 illustrates the electrical control system of the second embodiment 10' shown in FIG. 6. Upon closure of the ignition switch I, the switch 26 remains in the low pressure position 1, thus energizing the oil pump 16. After the pressure has reached the predetermined high pressure level, the switch 26 moves to position 2 causing power to be supplied to the motor 16 through the low temperature contact 1 of the thermostatic switch 38. After the temperature of the oil has risen to a predetermined level, the switch 38 moves to position 2 thus deactuating the pump 16 and energizing the starter motor solenoid S. Thus the engine is prevented from cranking and starting until the engine oil temperature and pressure have reached predetermined levels. This insures adequate oil flow through the internal engine oil passages, and is particularly suited for use in extremely cold climates.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An engine prelubricating system for use with an internal combustion engine system including a block with internal oil passages, an oil sump, a dipstick well communicating with the sump, an electrically actuated starter motor and solenoid, a battery, and an ignition switch, comprising:

an oil intake tube dimensioned for insertion into the dipstick well;

said oil intake tube having a lower end portion provided with a graduated scale for measuring oil quantity in the sump;

handle means on an upper end portion of said intake tube for facilitating manual removal and replacement of said tube from the dipstick well;

an electric oil pump;

first conduit means connecting said oil intake tube to an inlet side of said oil pump;

quick release coupling means connecting said oil intake tube to said first conduit means;

second conduit means connecting an outlet side of said pump to the internal oil passages of the block;

first check valve means in said oil intake tube for preventing oil from flowing from said tube back into the sump;

second check valve means in said second conduit means for preventing oil from flowing from the block to said pump outlet side;

and a pressure actuated switch connected in said second conduit means, said pressure actuated switch having a first low pressure position for connecting said electric pump to the battery when the ignition switch is closed and a second high pressure position for disconnecting the pump from the battery and for connecting the starter motor solenoid to the battery, whereby the engine cannot be started until a predetermined oil pressure is reached.

2. The engine prelubricating system of claim 1, wherein said quick release coupling includes a stem extending transversely from said oil intake tube adjacent said handle means.

3. The engine prelubricating system of claim 1, further comprising an oil filter connected in said second conduit means.

4. The engine prelubricating system of claim 1, further comprising an electric oil heater connected in said second conduit means.

5. The engine prelubricating system of claim 1, further comprising a thermostatic switch operatively connected for actuating said oil pump and for preventing activation of the starter motor solenoid until a predetermined oil temperature is reached.

6. The engine prelubricating system of claim 3, wherein said oil heater includes a resistant heating element having means for connection to a conventional AC power source.

7. An engine prelubricating system for use with an internal combustion engine system including a block with internal oil passages, an oil sump, a dipstick well communicating with the sump, an electrically actuated starter motor and solenoid, a battery, and an ignition switch, comprising:

an oil intake tube dimensioned for insertion into the dipstick well;

said oil intake tube having a lower end portion provided with a graduated scale for measuring oil quantity in the sump;

handle means on an upper end portion of said intake tube for facilitating manual removal and replacement of said tube from the dipstick well;

an electric oil pump;

first conduit means connecting said oil intake tube to an inlet side of said oil pump;

quick release coupling means connecting said oil intake tube to said first conduit means;

said quick release coupling means including a stem extending transversely from said oil intake tube adjacent said handle means;

second conduit means connecting an outlet side of said pump to the internal oil passages of the block;

first check valve means in said oil intake tube for preventing oil from flowing from said tube back into the sump;

second check valve means in said second conduit means for preventing oil from flowing from the block to said pump outlet side;

an oil filter connected in said second conduit means;

an electric oil heater connected in said second conduit means;

said oil heater including a resistant heating element having means for connection to a conventional AC power source;

a thermostatic switch operatively connected for actuating said oil pump for preventing activation of the starter motor solenoid until a predetermined oil temperature is reached;

and a pressure actuated switch connected in said second conduit means, said pressure actuated switch having a first low pressure position for connecting said electric pump to the battery when the ignition switch is closed and a second high pressure position for disconnecting the pump from the battery and for connecting the starter motor solenoid to the battery, whereby the engine cannot be started until a predetermined oil pressure is reached.

* * * * *